US006199360B1

(12) United States Patent
Premi

(10) Patent No.: US 6,199,360 B1
(45) Date of Patent: Mar. 13, 2001

(54) DEVICE FOR PNEUMATIC SPLICING OF THREADS AND YARNS TO BE INSTALLED ON TEXTILE MACHINES

(75) Inventor: Mauro Premi, Saló (IT)

(73) Assignee: Mesdan S.p.A., Salo (IT)

( * ) Notice: Subject to any disclaimer, the term of this patent is extended or adjusted under 35 U.S.C. 154(b) by 0 days.

(21) Appl. No.: 09/301,720

(22) Filed: Apr. 29, 1999

(30) Foreign Application Priority Data

Jun. 10, 1998 (IT) ..... MI98A 1316

(51) Int. Cl.[7] ..... D01H 15/00
(52) U.S. Cl. ..... 57/22; 242/475.4
(58) Field of Search ..... 57/22; 242/475.4

(56) References Cited

U.S. PATENT DOCUMENTS

| | | | | |
|---|---|---|---|---|
| 4,411,128 | | 10/1983 | Mima . | |
| 4,610,132 | * | 9/1986 | Rohner et al. | 57/22 |
| 4,938,013 | * | 7/1990 | Zumfeld | 57/22 |
| 5,680,751 | | 10/1997 | Premi . | |
| 6,039,281 | * | 3/2000 | Badiali et al. | 242/475.5 |

* cited by examiner

*Primary Examiner*—Andy Falik
(74) *Attorney, Agent, or Firm*—Oblon, Spivak, McClelland, Maier & Neustadt, P.C.

(57) ABSTRACT

A device for pneumatic knotless splicing of ends of thread or yarn. There is provided a cylindrical cavity, which is connected to a source of compressed air. In the cylindrical cavity, a piston rod is displaceable in both directions. A piston rod is actuated by an actuation lever, from a cam track of a drum. The track is divided at one section into two parallel branches. A first branch is used during rotation of the drum in a forward direction to displacement of the rod in one direction. A second branch is used during rotation of the drum in a return direction to displacement of the rod in the opposite direction. The cylindrical cavity with the piston rod constitutes a slide valve, for introducing compressed air into the devices for preparation of the ends of thread or yarn to be joined, when the rod is actuated in order to be displaced in the one direction, and to introduce the compressed air into the splicing chamber, when the rod is actuated in order to be displaced in the opposite direction, for execution of the pneumatic splicing of the two ends of thread or yarn. A specific amount of free play is provided in a lever transmission between the cam with an increasing profile and the drawing levers. The drawing levers are provided with braking means, to keep them stopped in the displaced position, on completion of the forward rotation of the drum.

5 Claims, 6 Drawing Sheets

DEVICE FOR PNEUMATIC SPLICING OF THREADS AND YARNS TO BE INSTALLED ON TEXTILE MACHINES

BACKGROUND OF THE INVENTION

The present invention relates to a device for pneumatic knotless splicing of threads or yarns, to be installed on textile machines, in particular on automatic spoolers.

The invention is based on a device of this type known from U.S. Pat. No. 5,680,751, or from the corresponding patent DE 196 10 818, from which known device the device according to the invention takes and maintains all the prerogatives and main characteristics, in particular those of permitting remote centralised regulation of the basic parameters of the splicing cycle, such as the duration both of the jet of compressed air used for preparation and pre-treatment of the ends of the thread or yarn to be joined, and of the jet of compressed air used in the splicing chamber, for execution of the knotless pneumatic splicing of the ends of the thread or yarn, and the length of overlapping of the prepared ends of the thread or yarn at the moment of splicing.

In the known device, the compressed air is admitted into the splicing chamber, and optionally also the compressed air is admitted into the units for preparation of the ends of the thread or yarn to be joined, by means of solenoid valves which can be controlled separately, remotely from the device, thus making the device to some extent dependent on other units of the textile machine on which the splicing device is installed.

The object of the present invention is mainly to eliminate this dependence of the splicing device on other units installed on the textile machine, thus making it independent from separate solenoid valves, which are remote from the points of use of the jets of compressed air.

For its actuation, like the known device, the splicing device according to the invention also comprises its own small, reversible electric stepper motor, which can be controlled remotely by electric pulses, in order to give rise to rotation in steps from a starting position, in a forward direction, and then, after a specific number of advance steps, to rotation in a direction of return, of a set of drum control cams, and of a cam in this set which controls the movement of the levers to draw the ends of the yarn or thread from the preparation units, in the direction of the splicing chamber, the said cam having a profile which increases progressively, and preferably in steps.

In order to achieve the above-described object of making the splicing device independent from separate units of the machine on which the device is installed, and in particular from a distinct, separate solenoid valve to control the intake of the jet of compressed air into the splicing chamber, according to the invention the device is provided with a slide valve which can be actuated by a specific cam in the set of drum cams, which cam is divided, for a limited section, into two parallel branches, the first in order to give rise, during rotation of the cam drum in the forward direction, to displacement of the rod of the slide valve in one direction, and the second, in order to give rise, during rotation of the cam drum in the direction of return, to displacement of the rod of the slide valve in the opposite direction, a specific amount of free play also being provided in the lever transmission, between the said cam with an increasing profile and the drawing levers, and the drawing levers being provided with braking means, in order to keep them stopped in the displaced position, on completion of the forward rotation of the cam drum.

SUMMARY OF THE INVENTION

In the device according to the invention, when the cam drum is rotated in the forward direction by the small stepper motor, by means of displacement of its rod in one direction, the slide valve controls the intake of the jet of compressed air into the units for preparation of the ends of the thread or yarn to be joined, and then, via the cam with an increasing profile, the drawing levers are displaced from their rest position, as far as the position which corresponds to the required overlapping of the prepared ends of the thread or yarn, after which the rotation in steps of the cam drum in the forward direction is stopped and inverted, whereas the drawing levers are kept stopped in the position reached, by the said braking means, and, during rotation of the cam drum in the return direction, by means of the second of the said two parallel branches, the rod of the slide valve is displaced in the opposite direction, and the valve controls intake of the jet of compressed air into the splicing chamber, for execution of the knotless splicing of the two ends of thread or yarn. It should be pointed out that unlike in the known device on which the present invention is based, in the present case, on completion of its advance in steps in the forward direction, and before it begins the rotation in the return direction, the rotation of the small electric motor is not stopped, such that the cam with a progressively increasing profile can keep the return levers for the prepared ends of the thread or yarn in the displacement position reached, since the rod of the slide valve must immediately begin its return displacement, such that the valve can control the intake of the jet of compressed air into the splicing chamber, and a separate solenoid valve is no longer provided for this purpose.

It is for this reason that in the device according to the invention, the return levers must be provided with braking means, in order to allow them to remain in the displaced position reached, and also, in the lever transmission between the cam with an increasing profile and the drawing levers themselves, a specific amount of free play must be provided, in order to allow the cam with an increasing profile to carry out its return movement to the starting position, without also immediately dragging with it the drawing levers also. This free play is eliminated only on completion of rotation of the cam drum, when the movement of the drum is inverted.

Simply by means of remote control by electrical pulses transmitted to the small, reversible electric stepper motor, the device according to the invention makes it possible to carry out three types of regulation, i.e.: by stopping the small electric motor at the moment when the rod of the slide valve is in the position which permits intake of the compressed air into the units for preparation of the ends of the thread or yarn, it is possible to regulate the duration of this jet of compressed air, and thus the efficiency of the preparation of the ends of the thread or yarn; by stopping the small electric motor again during its return rotation, at the moment when the rod of the slide valve is in the position in which it opens the intake of the jet of compressed air into the splicing chamber, throughout the stoppage time it is possible to regulate the duration of the jet of compressed air in the splicing chamber, and thus the efficiency of knotless pneumatic splicing; finally, by determining the steps of advance in the forward direction, and the moment of inversion of the rotation of the small electric motor, it is possible to establish the position of displacement reached by the drawing levers, and thus the required overlapping of the prepared ends of the thread or yarn in the splicing chamber during execution of the pneumatic splicing.

By providing a slide valve inside the splicing device, it has also been possible to allocate to this valve an additional task which has not hitherto been carried out pneumatically in the known devices, i.e. of controlling closure of the cover of the splicing chamber. In fact, hitherto, this control has always been carried out purely mechanically, by means of a cam of the cam drum, and corresponding lever transmission.

Positioning the slide valve in the device in the immediate vicinity of the units which use the compressed air, also has the advantage of avoiding dead time caused by the path of the compressed air, from the point at which the supply is opened up and released (for example separate, remote solenoid valve), to the point at which it is used (for example splicing chamber). In addition, the efficiency of the compressed air at the point at which it is used is increased. The use of compressed air in closure of the cover of the splicing chamber also has the advantage of improving the closure, compared with that obtained by means of a spring, and of increasing the closure force. In addition, there is elimination from the cam drum of a cam track which was necessary hitherto in order to control the cover.

BRIEF DESCRIPTION OF THE DRAWINGS

Further characteristics and advantages of the invention will become more apparent from the following detailed description of an embodiment of the splicing device produced with reference to the attached drawings, in which.

DESCRIPTION OF THE PREFERRED EMBODIMENT

The splicing device according to the invention is also designed in particular to be installed in an operating position of a textile machine, and specifically of an automatic spooler, as described in the previous U.S. Pat. No. 5,680,751 and the corresponding patent DE 96 10 818, to which reference is specifically made for further details which are not illustrated in the attached drawings.

As already described in these previous patents, the textile machine on which the splicing device is installed has at its head an electronic computer control system, from which, by means of electrical signals, there can be emitted all the various commands for functioning of the machine and of the splicing devices which are installed on it.

Figure 1:
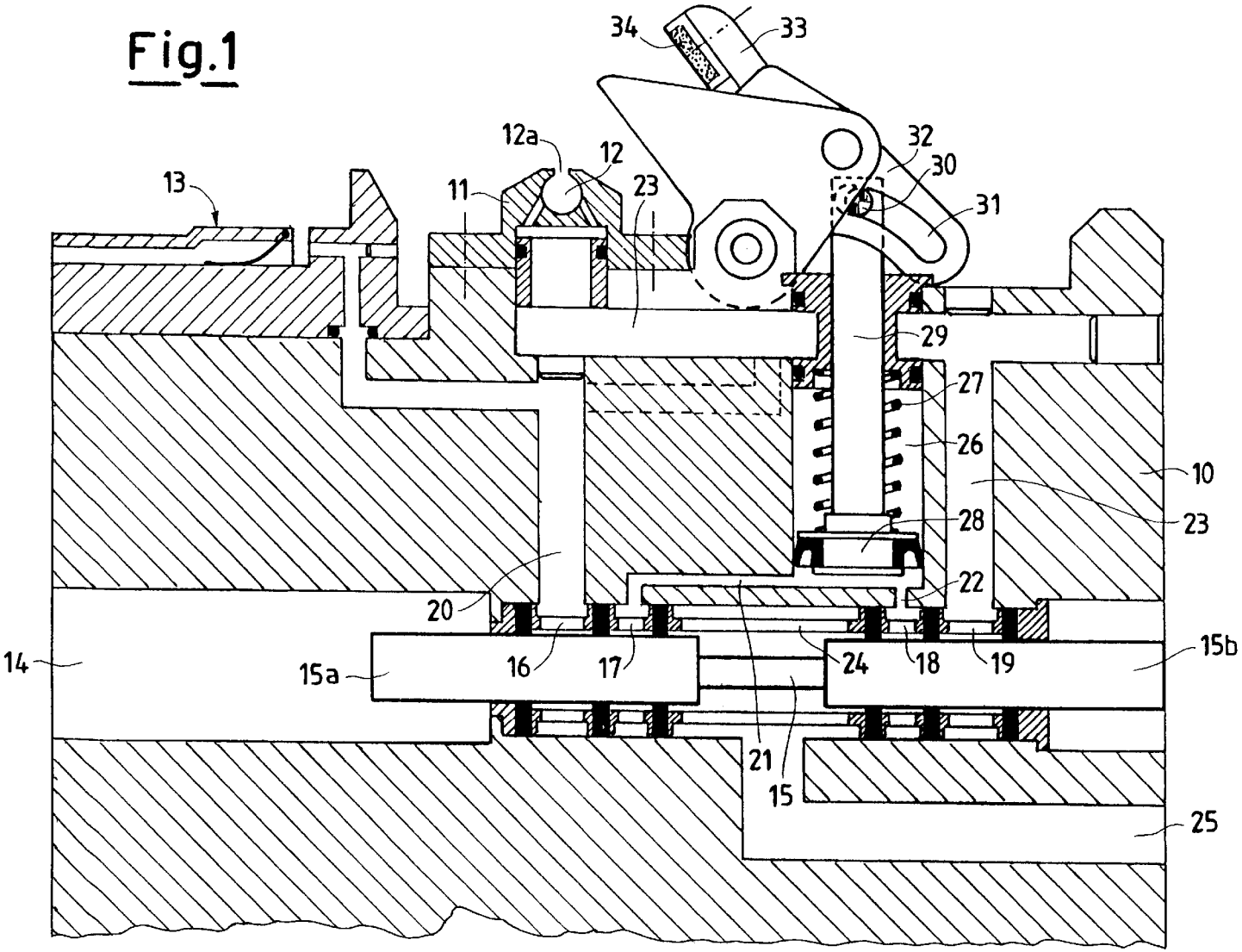
FIG. 1 shows in vertical cross-section the upper part of the splicing device in the rest condition.
Figure 2:
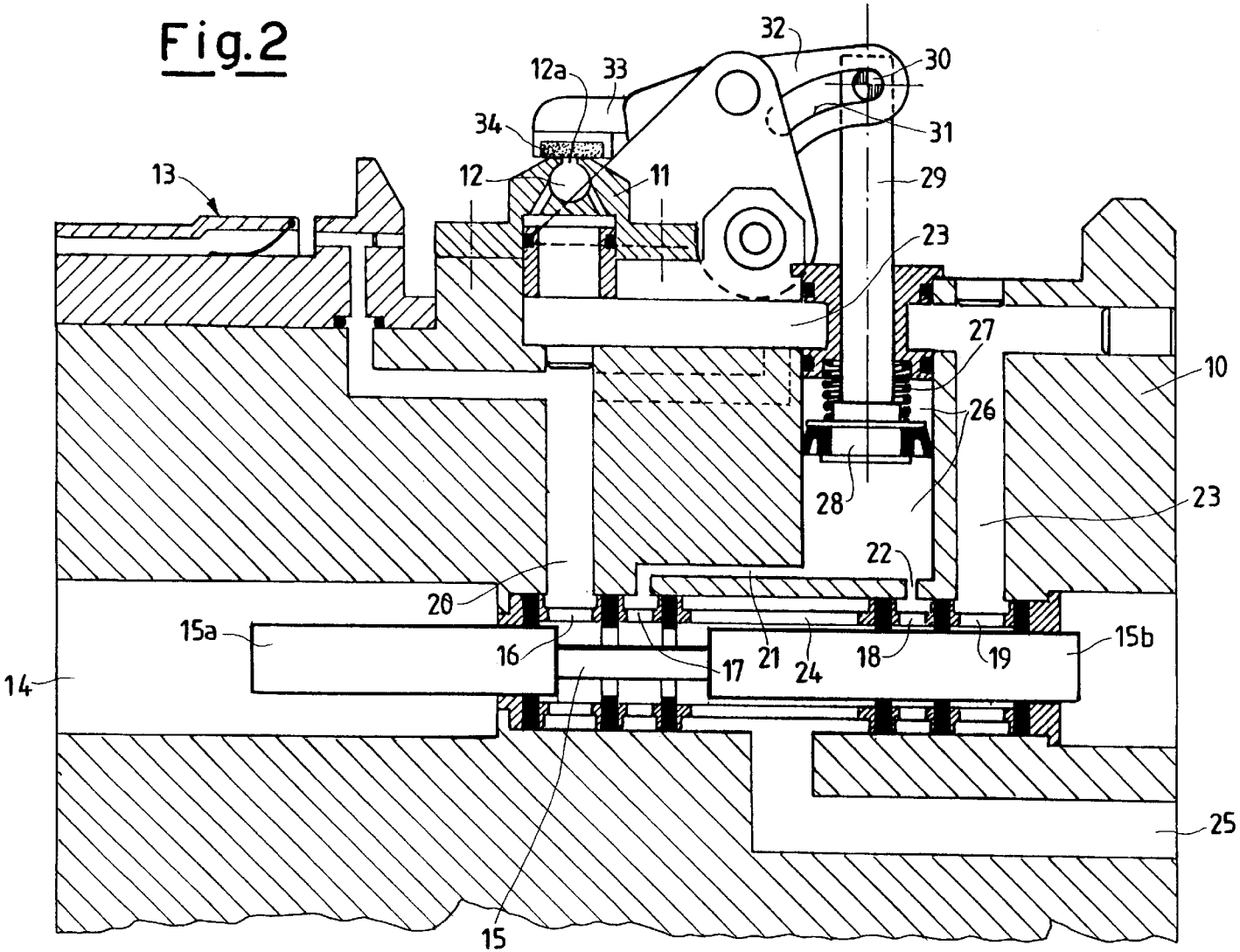
FIGS. 2 and 3 show the device in cross-sections similar to those of FIG. 1, but in two different operating conditions.
Figure 3:
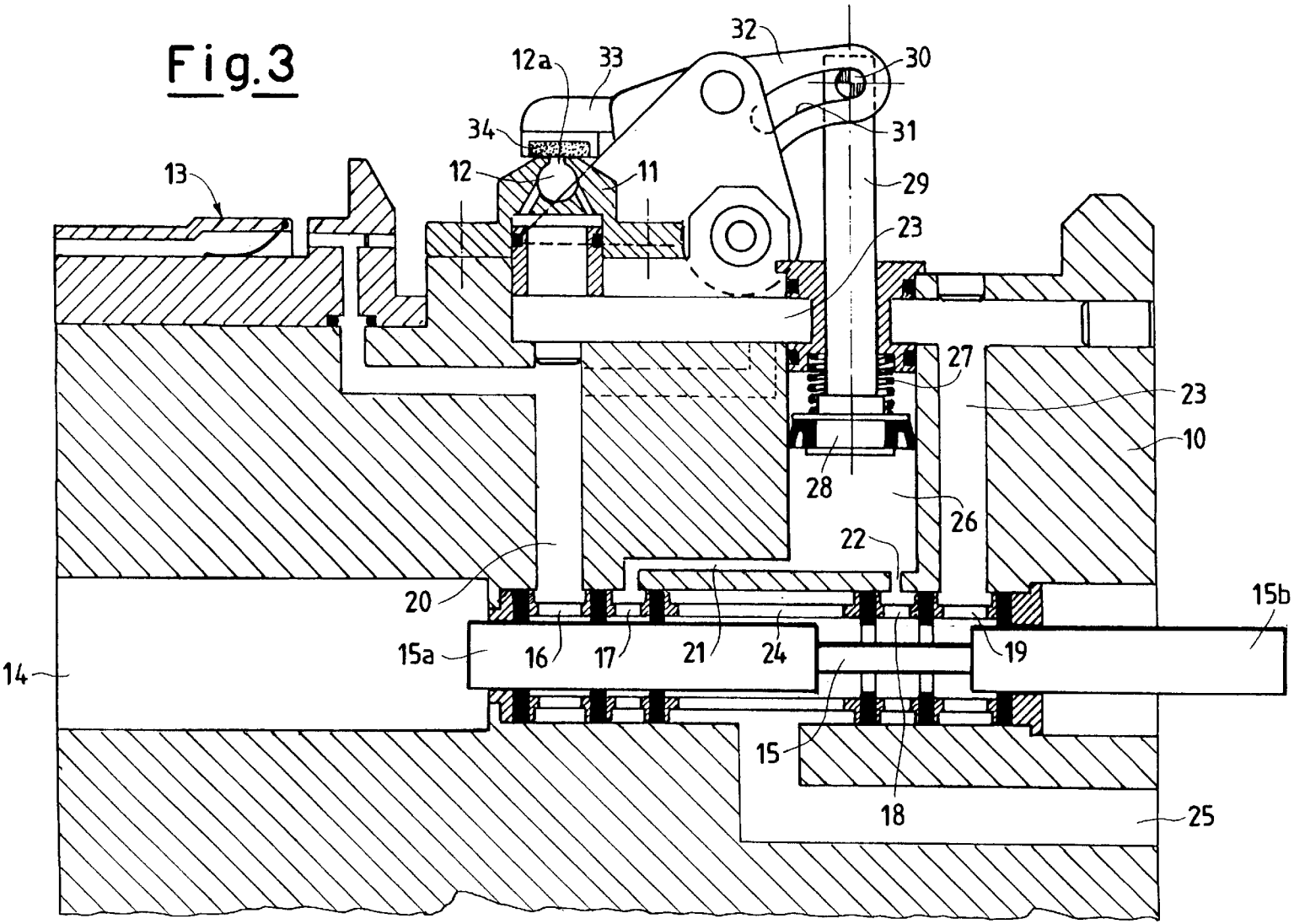

The splicing device illustrated in the drawings consists of a body 10, which is partially hollow, on which there is mounted a head 11 which contains the splicing chamber 12, with an upper longitudinal slot 12*a*, and there are also mounted the devices for preparation of the ends of the threads or yarn to be joined, of which devices one can be seen in FIGS. 1 to 3, and is indicated by the reference number 13. In the upper part of the body 10, there is provided a horizontal cylindrical cavity 14, in which there is mounted in a displaceable manner a rod 15, which supports two pistons 15*a* and 15*b*, which constitute a slide valve. In the rest position of the rod 15 and of the two pistons 15*a* and 15*b*, as illustrated in FIG. 1, the said pistons close four outlets 16, 17, 18 and 19 of the cylindrical cavity 14, which are connected to the same number of ducts 20, 21, 22 and 23 provided in the body 10 of the splicing device, whereas an inlet 24, which is connected via a duct 25 to a source of compressed air, not shown, remains open. The duct 20 leads to the devices for preparation of the ends of the thread or yarn, such as that indicated as 13 in the drawings, the ducts 21 and 22 are joined, and lead to a cylindrical chamber 26, which is also provided in the body 10 of the device, in which chamber a piston 28 is displaceable in contrast to the action of a spring 27, and finally the duct 23 leads to the head 11, and in particular to the splicing chamber 12 which is provided in this head.

In the rest position, the two pistons 15*a* and 15*b* prevent the intake of compressed air which comes from the duct 25 into the ducts 20 to 23. It should be pointed out that the four outlets 16 to 19 of the cylindrical cavity 14 are protected against the compressed air outlet by means of respective cylindrical seals. The rod 29 of the piston 28 is connected at the top via a pin 30 to a link 31 provided in a projection 32 of a cover-holder 33, which is mounted in a pivoting manner above the body 10 of the device. The cover 34 which is supported by this cover-holder 33 can close from above the longitudinal slot 12*a* of the splicing chamber 12, as can be seen in FIGS. 2 and 3.

Figure 4:
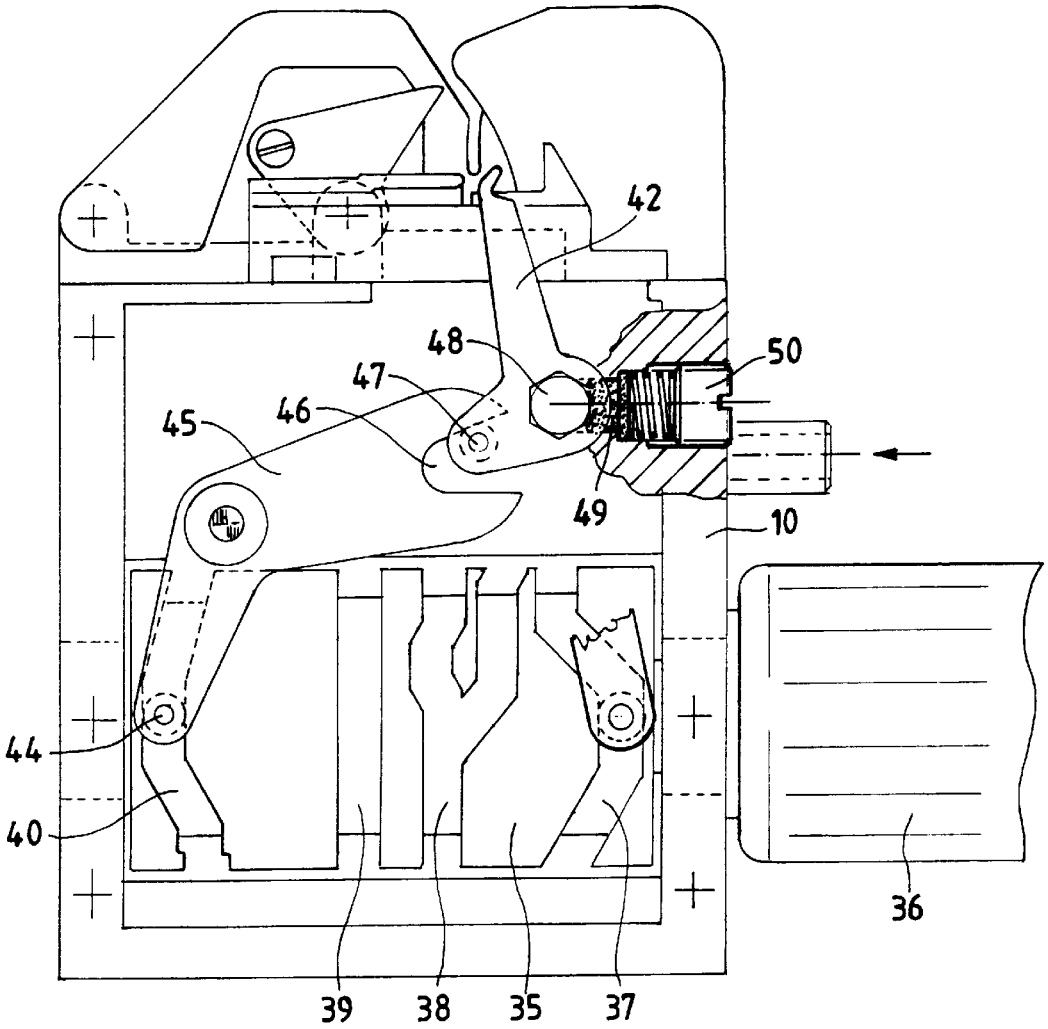
FIGS. 4 and 5 are two elevated views, from opposite sides of the device, with some parts removed.
Figure 5:
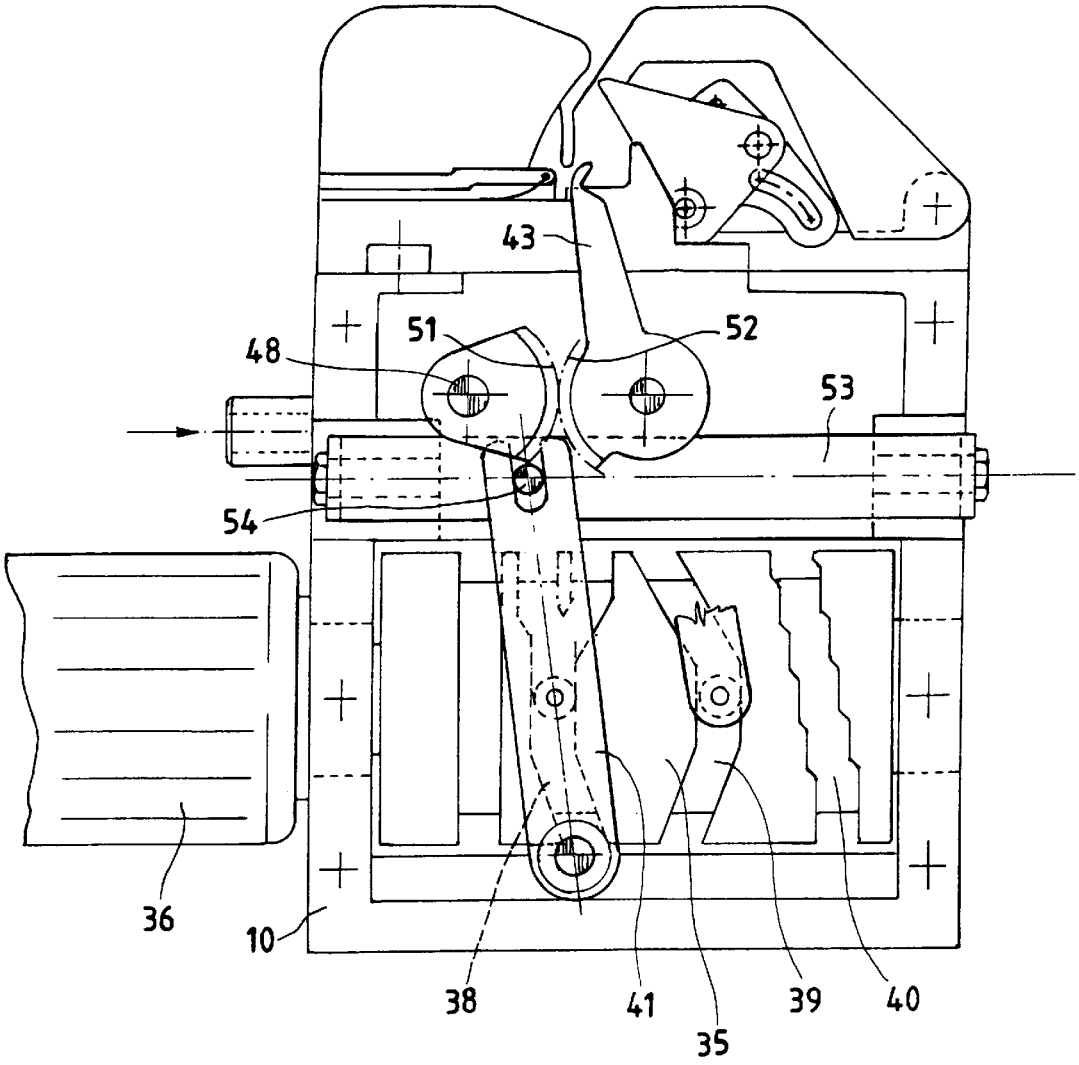
Figure 6:
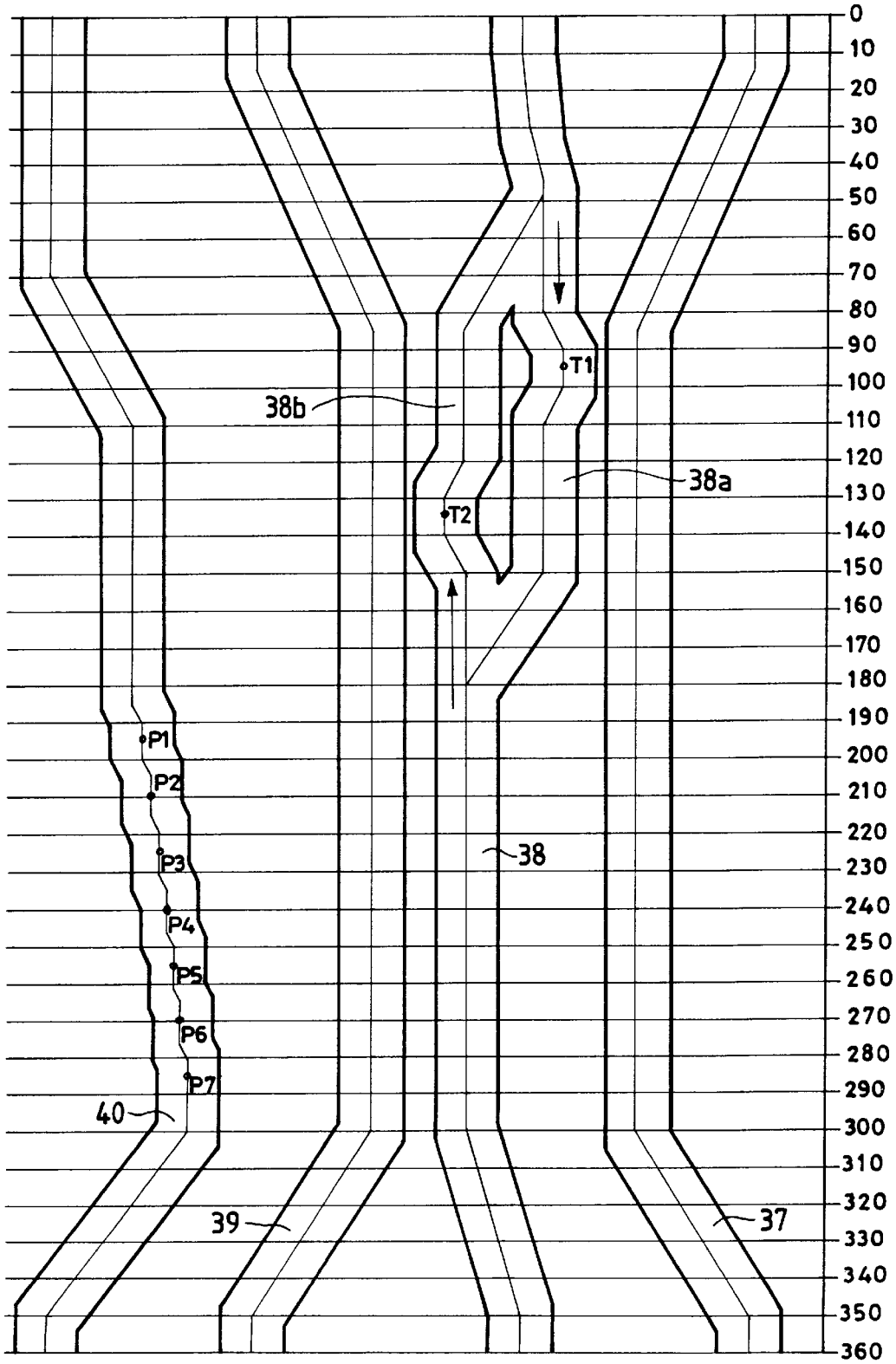
FIG. 6 shows the development of the drum, with the cams for controlling displacement of the movable units of the device.

In the lower, hollow part of the body 10 of the device, there is mounted such that it can rotate, a drum 35, on the periphery of which there are provided the cam tracks to control the displacement of the movable units of the device (see FIGS. 4 to 6). The shaft of this drum is connected to the shaft of a small, reversible electric stepper motor, which is mounted coaxially on the drum 35, on the exterior of the body 10, and is indicated by the reference number 36 (see FIGS. 4 and 5). In particular, the drum 35 has four cam tracks 37, 38, 39 and 40. The tracks 37 and 39 are used in a known manner, to control via respective lever mechanisms the stopping and cutting devices provided on both sides of the splicing chamber, which devices, since they are perfectly well known, are not described here in detail, or illustrated in the drawings. The cam track 38 is used via a lever 41 (see FIG. 5) to control the displacement in both directions of the rod 15 with the pistons 15*a* and 15*b* of the slide valve. At the free ends of the pistons 15*a* and 15*b*, there is connected by its arms an external bracket 53, which supports a pin 54 on which the lever 41 acts with its free end, for displacement in both directions of the rod 15 with the pistons 15*a* and 15*b* (see FIG. 5).

In an intermediate section, the track 38 is subdivided into two branches 38*a* and 38*b*, of which one branch 38*a* is used during rotation of the drum 35 in the forward direction, to displace the rod 15 towards the left, from the position of starting or rest illustrated in FIG. 1 (towards the position illustrated in FIG. 2), whereas the second branch 38*b* of the track 38 is used during rotation of the drum 35 in the return direction, to displace the rod 15 towards the right, from the position in FIG. 1 (towards the position in FIG. 3).

Finally, the cam track 40 has a profile which increases partially in steps, and this track is used to displace the drawing levers 42 and 43 for the prepared ends of the thread or yarn, in the manner described in the aforementioned previous patents, to which reference is made for further details in this respect.

The special feature provided by the present invention consists of the fact that with the cam track 40, there co-operates via a pin 44 (see FIG. 4) a triangular lever 45, which at its free end has a wide mouth 46, in which there is inserted a pin 47 which is integral with the drawing lever 42, leaving a specific amount of free play, as can be seen clearly in FIG. 4. When the triangular lever 45 rotates around its fulcrum in one direction, with its mouth 46 it drags with it the drawing lever 42, but when its direction of rotation is inverted, before the mouth 46 engages once more with the pin 47 of the drawing lever 42, the triangular lever 45 is allowed a specific angle of rotation in an unloaded condition, i.e. without dragging with it the drawing lever 42, which can thus remain stopped for a given time in the position it reaches when the triangular lever 45 inverts its direction of rotation. In order to ensure that the drawing lever 42 can remain stopped in the displacement position reached, on its fulcrum of rotation 48 there acts a brake block 49, the braking force of which can be regulated by means of a screw nut 50. The fulcrum of rotation 48 of the drawing lever 42 supports on the opposite side of the device a toothed segment 51, with which there engages a toothed segment 52, which is integral with the second drawing lever 43, such that by means of the rotary displacement of the drawing lever 42 controlled by the step cam 40, rotary displacement is also obtained of the drawing lever 43. The same also applies to stoppage of the two drawing levers in the positions reached, and locking of the levers by the braking means 49.

The functioning of the splicing device described is briefly as follows. When the computer control system for the automatic spooler receives the signal that the splicing device concerned must execute the splicing of two ends of thread or yarn inserted in the same device in order to be spliced, the electronic system sends the splicing device electrical signals in order to start up the small electric stepper motor 36, such as to give rise to rotation in steps of the cam drum 35 in the forward direction. By this means there are actuated firstly the devices for stopping and cutting the threads (via the cam tracks 37 and 39), whereas via the branch 38*a* of the cam track 38, the rod 15 with the pistons 15*a* and 15*b* of the slide valve is displaced from the position in FIG. 1 into the position in FIG. 2, such as to control: a) through the outlet 17 which is put into communication with the inlet 24, the intake of compressed air into the cylindrical chamber 26, and against the action of the spring 27, to give rise to displacement of the piston 28, which in turn gives rise to lowering of the cover 34 for closure of the longitudinal slot 12*a* of the splicing chamber 12, as well as b) through the outlet 16 which is put into communication with the inlet 24, the intake of compressed air into the preparation devices, such as 13, for the ends of the thread or yarn to be joined. At this point, i.e. when the compressed air enters the preparation devices, the small electric motor 36 and the cam drum 35 are stopped for a pre-determined time T1, which determines the duration of the pre-treatment of the ends of the thread or yarn. This time T1 is set in the electronic computer control system of the machine on which the splicing device is installed.

By way of example, and approximately, this stoppage time of the cam drum for the time T1 can be provided approximately after one rotation of the cam drum 35 in the forward direction by 80–90° from the starting position, as indicated in FIG. 6.

After the stoppage time, the small electric motor 36 receives further electric pulses, in order to make the cam drum 35 rotate further in the forward direction. During this rotational step, the step cam 40 comes into use, in order to displace from their starting position the drawing levers 42 and 43 for the prepared ends of the thread or yarn. The electronic system transmits a set number of electrical pulses, such as to displace the drawing levers by the desired amount, such as to obtain the required overlapping of the ends of the thread or yarn in the splicing chamber 12, at the moment of intake into the chamber itself of the compressed air for execution of the knotless pneumatic splicing. On completion of the advance steps in the forward direction of the cam drum 35, as set by the electronic computer control system, this system emits electronic pulses of inversion, and of advance of the cam drum in the return direction, such that the drawing levers 42 and 43 are no longer displaced from the angular position reached. This is made possible, according to the invention, because although the triangular lever 45 is moved in the direction of return to the starting position of the cam track 40, it does not transmit the return motion immediately to the drawing lever 42, owing to the presence of the free play between its wide mouth 46, and the pin 47 of the drawing lever 42. In this step, for a specific angle, the triangular lever 45 then carries out rotation in an unloaded condition, whereas the drawing lever 42, together with the second drawing lever 43 which is connected to it integrally by means of the toothed segments 51 and 52, remains stopped in the angular position reached, owing to the presence of the braking means 49. At this point, the small electric motor 36 transmits to the cam drum 35 the step movement in the return direction, with the consequence that the cam track 38 can control displacement of the rod 15 with the pistons 15*a* and 15*b* from the position in FIG. 2, towards the position in FIG. 3. During this return rotation of the cam drum 35, the roller pin of the lever 41, which is functioning in the track 38, no longer enters the branch 38*a* of this track, but goes straight ahead and enters the branch 38*b* (see FIG. 6), and thus the lever 41 controls the return displacement of the rod 15 of the slide valve. By this means, the pistons 15*a* and 15*b* control: a) through the outlet 18 of the cylindrical cavity 14, which is put into communication with the inlet 24, the intake of compressed air into the cylindrical chamber 26, in order to give rise once again to closure of the cover 34 of the splicing chamber 12, as well as b) through the outlet 19 which is put into communication with the inlet 24, the intake of compressed air into the splicing chamber 12, for execution of the knotless pneumatic splicing. At this point, when the compressed air reaches the splicing chamber, the small electric motor 36 and the cam drum 35 are stopped once again for a pre-determined time T2, which determines the duration of the action of the compressed air in the splicing chamber. This second stoppage time T2 is also set in the electronic computer control system. By way of example, this second stoppage of the cam drum 35 for the time T2 can be planned at a point of the return rotation of the drum 55 which corresponds to an angle of rotation of 130° in the forward direction, as indicated in FIG. 6. At this point, it should be pointed out that the stoppage points of the drum 35, both during the forward rotation and during the return rotation, are fixed and always the same, but the stoppage times T1 and T2 can vary according to the requirements and the corresponding setting of the electronic computer control system. On the other hand, what varies is the point at which the small electric motor 56 and the drum 35 receive the command for inversion of the rotational motion, according to the required extent of angular displacement of the drawing levers 42 and 43, in order to obtain the required overlapping of the prepared ends of the thread or yarn at the moment when they are spliced pneumatically in the splicing chamber. In any case, as shown in FIG. 6, the said point of inversion of the rotational motion of the small electric motor and of the cam drum can take place for example at a point which corresponds to rotation of the drum from the starting position by 195° to 290° in the forward direction.

The advantages which can be obtained according to the present invention are apparent from the preceding description. For functioning of the splicing device, units which are external to the device itself, such as solenoid valves and the like, are no longer required, with the exception of a computer control system which can emit electric control pulses, and can be set centrally, remotely, in order to carry out the three substantial regulations of the splicing device. The point at which there is made available the compressed air in order to carry out both preparation of the ends of the yarn or thread, and pneumatic splicing of these ends, is in the immediate vicinity of the points of use of the compressed air itself, such that losses of pressure and efficiency of the compressed air are avoided. The cover for closure of the splicing chamber is also controlled in its closure movements by compressed air, with an obvious increase in the efficiency of closure. The main three regulations of the functioning of the splicing device can also be carried out centrally, remotely from the device.

What is claimed is:

1. Device for pneumatic knotless splicing of ends of thread or yarn, to be installed on automatic spoolers of textile machines which are provided with an electronic computer control system, comprising a splicing chamber with a longitudinal slot for introduction of the ends of thread or yarn, a cover for temporary closure of the longitudinal slot of the splicing chamber, devices for pneumatic preparation of the ends of thread or yarn to be joined, which are disposed spaced from opposite lateral outlets of the splicing chamber, levers to draw the prepared ends of the thread or yarn from the preparation devices, in the direction of the splicing chamber, a control drum adapted to rotate around its own axis and containing a set of peripheral cam tracks to control the synchronised movements of the various movable units of the device, one of said cam tracks having a profile which increases progressively, a profile in steps, to control the drawing levers by means of a lever transmission, and a small, reversible electric stepper motor, which is connected to said drum, adapted to be actuated remotely by means of electrical pulses which are emitted by the said electronic system, characterised in that in its body, there is provided a cylindrical cavity, which is connected to a source of compressed air; in that in said cylindrical cavity, a piston rod is displaceable in both directions, the piston rod being actuated by means of an actuation lever, from a cam track of said drum; in that said track is divided at one section into two parallel branches, the first of which is used during rotation of the drum in a forward direction to displacement of the said rod in one direction, and the second branch is used during rotation of the drum in a return direction to displacement of the rod in the opposite direction, said cylindrical cavity with said piston rod constituting a slide valve, for controlling the intake of compressed air into the devices for preparation of the ends of thread or yarn to be joined, when said rod is actuated in order to be displaced in said one direction, and to control the intake of compressed air into the splicing chamber, when said rod is actuated in order to be displaced in said opposite direction, for execution of the pneumatic splicing of the two ends of thread or yarn; in that a specific amount of free play is provided in the lever transmission between said cam with an increasing profile and the drawing levers; and in that the drawing levers are provided with braking means, to keep them stopped in the displaced position, on completion of the forward rotation of the drum which is provided with the peripheral cam tracks.

2. Splicing device according to claim 1, characterised in that the slide valve is configured to control the movement of closure of the cover of the splicing chamber.

3. Splicing device according to claim 1, characterised in that the lever transmission between the cam with an increasing profile and the drawing lever comprises a triangular lever, which supports at one of its ends a pin, which engages with the track of the cam with an increasing profile, and has at its free end a wide mouth, in which there is inserted with play a pin which is integral with one of the two drawing levers, which transmits the motion to the other drawing lever, via a pair of toothed segments.

4. Splicing device according to claim 1, characterised in that the braking means for the drawing levers comprise a brake block, which acts on the fulcrum of rotation of one of the drawing levers, the said brake block being pressed against the said fulcrum with a force which can be varied by means of a screw nut.

5. Splicing device according to claim 2, characterised in that two outputs of the slide valve are connected to a cylindrical chamber in which, against the action of resilient means, there acts a piston, a rod of which is connected at its free end to a pivotable cover-holder.

* * * * *